US011661727B2

(12) United States Patent
Ames et al.

(10) Patent No.: US 11,661,727 B2
(45) Date of Patent: May 30, 2023

(54) WEAR MEMBER AND WEAR ASSEMBLY

(71) Applicant: ESCO GROUP LLC, Portland, OR (US)

(72) Inventors: Jared R. Ames, Portland, OR (US); Nicholas A. Albers, Portland, OR (US); Joseph E. Dengel, Tigard, OR (US); Michael D. Crowe, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 519 days.

(21) Appl. No.: 16/717,892

(22) Filed: Dec. 17, 2019

(65) Prior Publication Data

US 2020/0199854 A1 Jun. 25, 2020

Related U.S. Application Data

(60) Provisional application No. 62/783,057, filed on Dec. 20, 2018.

(51) Int. Cl.
*E02F 9/28* (2006.01)

(52) U.S. Cl.
CPC ..... *E02F 9/2858* (2013.01); *E02F 9/2816* (2013.01)

(58) Field of Classification Search
CPC ..... E02F 9/2816; E02F 9/2858
See application file for complete search history.

(56) References Cited

U.S. PATENT DOCUMENTS

| | | | | |
|---|---|---|---|---|
| 2,965,989 | A | 12/1960 | Hibbard | |
| 3,685,177 | A * | 8/1972 | Hahn | E02F 9/2816 37/446 |
| 3,851,413 | A * | 12/1974 | Lukavich | E02F 9/2841 37/450 |
| 3,864,853 | A | 2/1975 | Klett et al. | |
| 5,088,214 | A * | 2/1992 | Jones | E02F 9/2841 37/450 |
| 7,080,470 | B2 | 7/2006 | Jones | |
| 7,451,558 | B2 * | 11/2008 | Jones | E02F 9/2858 37/456 |
| 2004/0060209 | A1 * | 4/2004 | Watanabe | E02F 9/2883 37/452 |

(Continued)

FOREIGN PATENT DOCUMENTS

| | | | |
|---|---|---|---|
| EP | 2589715 | A2 | 5/2013 |
| JP | 2012246735 | A | 12/2012 |
| WO | 2013176551 | A1 | 11/2013 |

*Primary Examiner* — Gary S Hartmann
(74) *Attorney, Agent, or Firm* — Steven Schad; Palmer Dzurella

(57) ABSTRACT

A wear member for earth working equipment and a wear assembly including a plurality of such wear members. The wear member defines a longitudinal axis and comprises: a body defining a rearward opening cavity dimensioned to receive a base; first and second lateral portions extending from opposing sides of the body and defining a front edge for engaging earth. The first lateral portion defines a complementary formation to the second lateral formation to enable axial insertion and removal of a wear member mounted between adjacent wear members due to the open removal path defined by the complementary formations. The complementary formations also resist rotational movement of the wear member about the longitudinal axis.

15 Claims, 7 Drawing Sheets

(56) References Cited

U.S. PATENT DOCUMENTS

| | | | |
|---|---|---|---|
| 2004/0216334 | A1 | 11/2004 | Emrich et al. |
| 2015/0033596 | A1 | 2/2015 | Kunz |
| 2017/0328034 | A1 | 11/2017 | Campomanes et al. |

* cited by examiner

WEAR MEMBER AND WEAR ASSEMBLY

FIELD OF THE INVENTION

The field of the present disclosure relates to wear members for earth working equipment.

BACKGROUND OF THE INVENTION

During excavating operations, replaceable wear members are typically used to protect earth working equipment such as excavation buckets. During use, the wear members gradually wear down due to the abrasive conditions and heavy loading. Once depleted, the wear members are removed from the equipment and replaced. Using wear members provides a cost-effective approach to digging and other earth working operations because it lessens the need of having to repair or replace the more expensive underlying equipment such as the lip or other portions of the equipment.

A set of wear members are commonly secured to earth working equipment by mechanical means (for example, a lock pin, bolt, or other locking mechanism). A set of teeth can be installed to the lip of a digging bucket to break up the ground ahead of the bucket and to protect the bucket lip from excessive wear. Where the teeth wear evenly, the entire set of teeth can be replaced simultaneously at the end of their service life. However, during earth working operations, wear members may be subjected to a variety of directional forces, which can include axial, vertical, and lateral loads and impacts, that can result in damage to or earlier wearing of an individual tooth requiring replacement of a single tooth or less than all of the teeth.

SUMMARY OF THE INVENTION

The present invention pertains to wear members for earth working equipment that are mechanically secured to the equipment. The wear assemblies according to some embodiments of the invention are reliable, safe, easy to use, versatile, given to high productivity and/or can be individually replaced with little machine downtime.

According to a first aspect there is provided a wear member for earth working equipment, the wear member defining a longitudinal axis and comprising: a body defining a rearward opening cavity dimensioned to receive a base; first and second lateral portions extending from opposing sides of the body and defining a front edge for engaging earth, the first lateral portion defining a complementary formation to the second lateral formation to enable axial insertion and removal of a wear member mounted between adjacent wear members due to the open removal path defined by the complementary formations, and to resist rotational movement of the wear member about the longitudinal axis.

The wear member optionally further comprises a lip mount including a pair of rearward extending portions disposed on opposing lateral sides of the body and being dimensioned to engage on an upper and lower surface of a lip plate on an excavating bucket to provide further resistance to rotational movement of the wear member about the longitudinal axis. The lip mount also reduces gaps between adjacent wear members, thereby reducing the potential for ingress of debris or other particles into the lateral portions.

Optionally, each of the pair of rearward extending portions comprises a pair of arms dimensioned and configured to engage with the lip plate.

Optionally, the complementary formations on the first and second lateral portions comprise offset planar surfaces.

Optionally, the planar surfaces are offset in a direction transverse to a plane extending through one of the first and second lateral portions. In some embodiments, the planar surfaces are vertically offset from each other, so that one planar surface slides immediately below the other planar surface.

Optionally, the planar surfaces have substantially the same lateral width and extend forwards of the body.

Optionally, the first and second lateral portions provide a seal to reduce or prevent ingress of earth or other material into the wear member.

Optionally, the front edge provides a continuous edge substantially free from gaps, or alternatively completely free from gaps.

Alternatively, the front edge may define a serrated edge, or an edge defining spaced gaps therealong, such as between adjacent teeth. A serrated edge may provide better earth penetration for the earth working equipment.

Optionally, the wear member further comprises a third lateral portion located beneath the second lateral portion, and defining an upper surface, the second and third lateral portions defining an insertion gap therebetween, and the first lateral portion further comprises an insertion portion defined by the complementary formation of the first lateral portion and a lower surface on an opposite side of the first lateral portion to the complementary formation. This enables the insertion portion of one wear member to be inserted into the insertion gap of an adjacent wear member.

Optionally, the third lateral portion extends for substantially the same lateral width as the second lateral portion but only extends part-way along the length of the second lateral portion.

Optionally, the third lateral portion is located closer to a rear of the wear member than to the front edge.

Optionally, the upper surface of the third lateral portion and the complementary formations of the first and second lateral portions are all planar surfaces.

Optionally, the complementary formations of the first and second lateral portions are surfaces that are spaced apart but generally aligned relative to a plane (for example, by deviating by ten degrees or less from a line parallel to the plane), or closely aligned (for example, by deviating by five degrees or less from a line parallel to the plane), or generally parallel (for example, by deviating by approximately two degrees or less from a line parallel to the plane). In one embodiment, the engaging formation of the first lateral portion (for example, an upper surface) may slope at a small angle (less than five degrees) away from the body such that the height of the first lateral portion reduces as it extends away from the body. Similarly, the engaging formation of the second lateral portion (for example, a lower surface) may slope at a similar small angle towards from the body such that the height of the second lateral portion increases as it extends towards from the body.

According to a second aspect there is provided a wear member for earth working equipment, the wear member defining a longitudinal axis and comprising: a body defining a rearward opening cavity dimensioned to receive a base; a first and second lateral portions extending from opposing sides of the body and defining a front edge for engaging earth; a coupling surface defined by the first lateral portion; an arm upstanding from the second lateral portion transverse to the longitudinal axis and extending from the front edge towards the body, the arm defining an inner face opposite the body and inclined thereto to guide earth towards the body.

Optionally, the wear member further comprises a lip mount including a pair of rearward extending portions disposed on opposing lateral sides of the body and being dimensioned to engage on an upper and lower surface of a lip plate on an excavating bucket to provide further resistance to rotational movement of the wear member about the longitudinal axis.

Optionally, each of the pair of rearward extending portions comprises a pair of arms dimensioned and configured to engage with the lip plate.

Optionally, the first lateral portion is on a left side of the body and the coupling surface is defined on a lower surface of the first lateral portion, and the wear member further comprises a third lateral portion located beneath the first lateral portion, and defining an upper surface, the first and third lateral portions defining an insertion gap therebetween.

Optionally, the first lateral portion is on a right side of the body and the coupling surface is defined on an upper surface of the first lateral portion for insertion into an insertion gap by movement along the longitudinal axis.

According to a third aspect there is provided a wear assembly for earth working equipment, the wear assembly comprising: a lip plate for mounting on an excavating bucket; first, second and third adapters mounted on the lip plate and each defining a base protruding therefrom; first, second and third wear members, each having a base secured to a corresponding adapter and each wear member defining a longitudinal axis, each wear member comprising: first and second lateral portions extending from opposing sides of the body and defining a front edge for engaging earth, the first lateral portion defining a complementary formation to the second lateral formation, whereby the second wear member can be inserted between, or removed from, a gap between the first and third wear members due to an open removal path defined by the complementary formations on the first and second wear members and the second and third wear members, respectively.

Optionally, the wear member further comprises: a third lateral portion located beneath the second lateral portion, and defining an upper surface, the second and third lateral portions defining an insertion gap therebetween, and the first lateral portion further comprises an insertion portion defined by the complementary formation of the first lateral portion and a lower surface on an opposite side of the first lateral portion to the complementary formation.

Optionally, the third lateral portion extends for substantially the same lateral width as the second lateral portion but only extends part-way along the length of the second lateral portion.

Optionally, the third lateral portion is located closer to a rear of the wear member than to the front edge.

According to a fourth aspect there is provided a bucket including a plurality of the wear members (such as teeth), with any of the above-noted constructions to define a generally continuous front edge.

According to a fifth aspect there is provided a bucket including a wear assembly having wear members having any of the above-noted constructions to define a generally continuous front edge.

According to a sixth aspect there is provided a method of seating a wear member to an edge includes positioning a first wear member adjacent a second wear member seated to the edge and adjacent a third wear member seated to the edge so a first lateral portion of the first wear member overlaps the second wear member and a second lateral portion of the first wear member overlaps the third wear member and moving the first wear member rearward to seat on the edge.

According to a seventh aspect there is provided a method of removing a wear member of a wear assembly from an edge includes moving a first wear member from a seated position on the lip away from the lip with lateral portions on opposite sides of the first wear member overlapping second and third wear members on opposite sides to disengage the first wear member from the assembly.

According to an eighth aspect there is provided a wear member for earth working equipment, the wear member defining a longitudinal axis and comprising: a body defining a rearward opening cavity dimensioned to receive a base; first and second lateral portions extending from opposing sides of the body and defining a front edge for engaging earth, the first lateral portion defining a complementary formation to the second lateral formation to enable insertion and removal of a wear member mounted between adjacent wear members; and a lip mount including a pair of rearward extending portions disposed on opposing lateral sides of the body and being dimensioned to engage on an upper and lower surface of a lip plate on an excavating bucket to provide resistance to rotational movement of the wear member about the longitudinal axis.

In one embodiment, a wear member for earth working equipment includes overlapping lateral portions to close gaps between adjacent wear members and/or provide support against the applied loads during use. The overlapping lateral portions maintain an open removal path that permits removal of the wear member without removal the adjacent overlapped wear members.

In another embodiment, a wear member for earth working equipment has a front portion for engaging the earth, a rearward opening cavity to receive a base and lateral portions to overlap wear members on both sides. The wear member is installed to the lip between adjacent overlapping installed wear members free of interference. In another embodiment the wear member on one side includes upper and lower lateral portions that form an opening to receive a lateral portion of an adjacent wear member.

In another embodiment, a wear member includes a forward working portion to engage the earth, a cavity opening rearward at a rear mounting portion to receive a base, a longitudinal axis and left and right staggered wings extending away from the longitudinal axis each with a planar surface substantially parallel to the longitudinal axis to bear on a planar surface of an adjacent wear member. In an additional embodiment, the wear member includes a third wing that extends from the longitudinal axis to form an opening that receives a wing of an adjacent wear member. In an additional embodiment, the mounting portion includes rearward extending members on each side of the cavity to straddle and bear on the lip. In an additional embodiment, each planar surface extends from the rear portion to the front working portion.

In another embodiment, an excavating tooth for a bucket includes a mounting cavity, a front edge and at least one lateral extension to engage a lateral extension of at least one other tooth to define a generally continuous edge along the front edges of adjacent teeth, wherein the tooth can be removed from the bucket without requiring removal of an adjacent tooth.

In another embodiment, an excavating tooth for a bucket includes a mounting cavity, a front edge, legs to straddle the lip, and a pair of wings extending laterally from the cavity to engage complementary wings on adjacent teeth and thereby define a generally continuous edge along the front edges of the adjacent teeth.

In another embodiment, an excavating tooth for a bucket includes a mounting cavity, a front edge, a lateral extension to engage a lateral extension of an adjacent tooth to define a generally continuous edge along the front edges of the adjacent tooth, and an upright guide along a side opposite the lateral extension to guide earthen material into the bucket during use. The guide optionally includes an inwardly inclined portion and/or an inward curve. This tooth is suitable to form an end of the generally continuous edge of teeth.

In another embodiment, an excavating tooth for a bucket includes a mounting cavity, a front edge, a lateral extension to overlap a lateral extension of an adjacent tooth to define a generally continuous edge along the front edges with the adjacent tooth, and a wing opposing the lateral extension to sandwich the lateral extension of the adjacent tooth. The wing has a reduced dimension and/or rearward location to minimize removal force and/or reduce the distance for complete disengagement.

In another embodiment, a wear assembly includes first, second and third wear members secured to an edge of earth working equipment in adjacent laterally overlapping positions where the second wear member adjacent the first and third wear member can be removed from the wear assembly without interference from (and without having to loosen or remove any parts from) the first and third wear members. In another embodiment each wear member can optionally include rearward extending stabilizing portions to straddle the edge.

In another embodiment a wear assembly on an edge of earthmoving equipment includes a plurality of overlapping wear members that form a continuous edge free from open spaces between the wear members at the edge, and a first wear member can be removed from the lip without removing an adjacent second wear member.

The various features of the above-noted embodiments can be used independently of each other or collectively with all or some of the different features in securing a wear member to an edge of earth working equipment. The noted features are exemplary summary observations of certain ideas of the various concepts of the invention and are not intended to be exhaustive or essential. The foregoing and other objectives, features, and advantages of the disclosed embodiments will be more readily understood in view of the following detailed description of certain embodiments and the accompanying drawings. Understanding that the drawings depict only certain embodiments and are not, therefore, to be considered limiting in nature, these embodiments will be described and explained with additional specificity and detail.

DETAILED DESCRIPTION OF DISCLOSED EMBODIMENTS

Wear members are applied to many kinds of earth working equipment to extend the service life of the equipment. The present invention is related to wear members secured along the digging edge of a bucket, their assemblies, and methods for installing and removing wear members on such edges.

Figure 1:
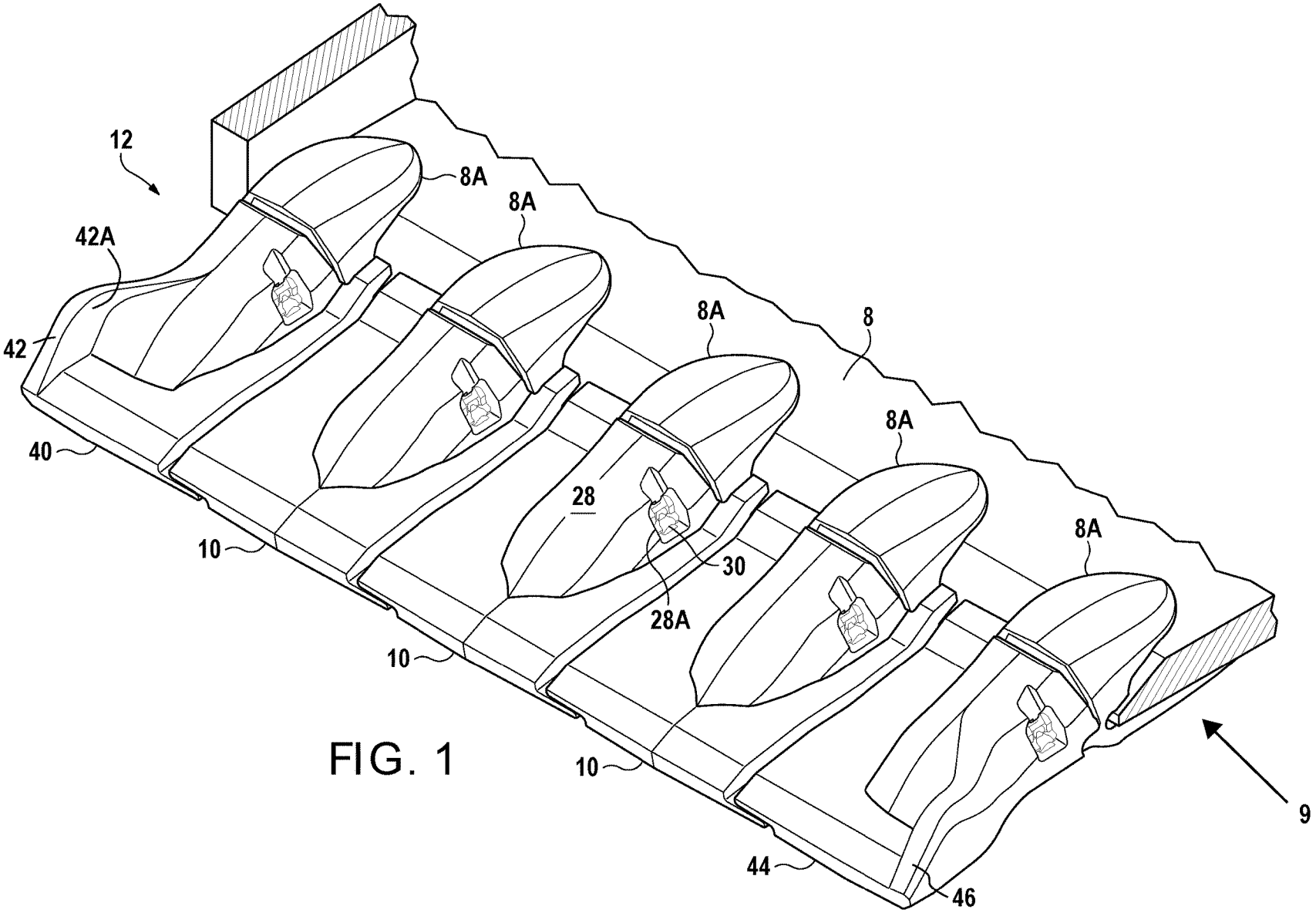
FIG. 1 is an upper perspective view of a wear assembly.
Figure 8:
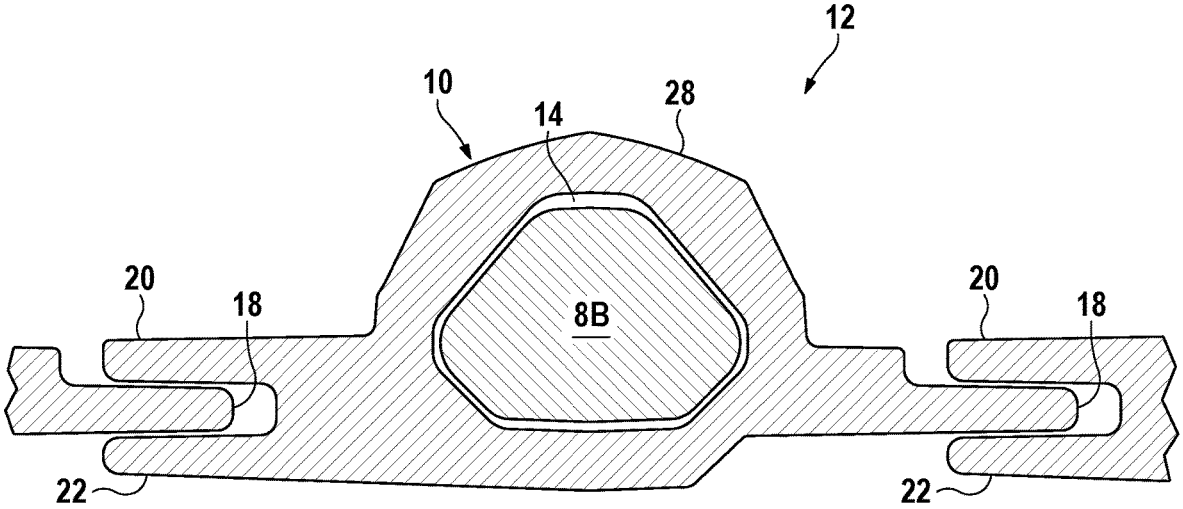
FIG. 8 is a cross section view of a portion of the wear assembly of FIG. 1.
Figure 9:
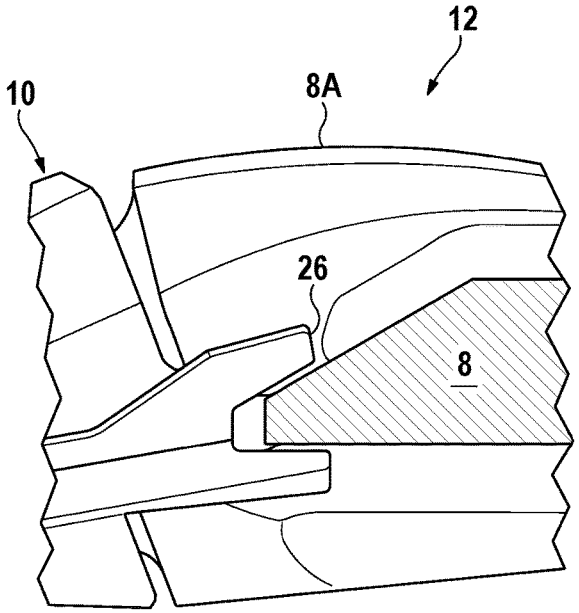
FIG. 9 is a perspective view of a partial cross section portion of the wear assembly of FIG. 1 from a first side.
Figure 10:
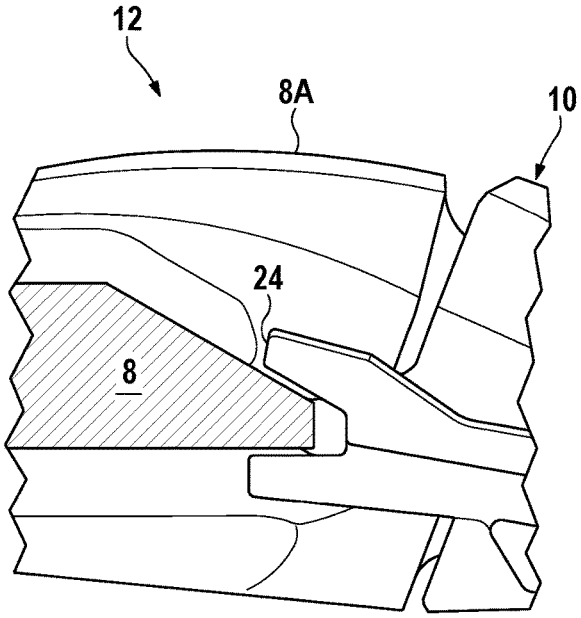
FIG. 10 is a perspective view of a partial cross section portion of the wear assembly of FIG. 1 from a second side opposite the first side of FIG. 9.

Referring now to the Figures, FIG. 1 shows a wear assembly 12 including wear members 10, where the wear assembly 12 is designed to be attached to earth working equipment. In the illustrated example, the wear member 10 is a point or tooth. The wear assembly 12 includes a profiled lip 9 onto which the teeth 10 are attached. The profiled lip 9 comprises a lip plate 8 attached to an edge (not shown) of an earthmoving bucket (not shown) and adapters 8A welded to the lip plate 8. Each adapter 8A defines a nose 8B (best seen in FIG. 8) extending therefrom and protruding beyond the lip plate 8. The adapters 8A could alternatively be secured by mechanical means such as a Whisler (trade mark) wedge and clamp, or the noses 8B could be formed as part of the lip plate 8. The lip plate 8 can have a variety of different designs but preferably has a linear leading surface. The profiled lip 9 has a direction of advance during operation of the earth working equipment (e.g., a digging operation).

Figure 2:
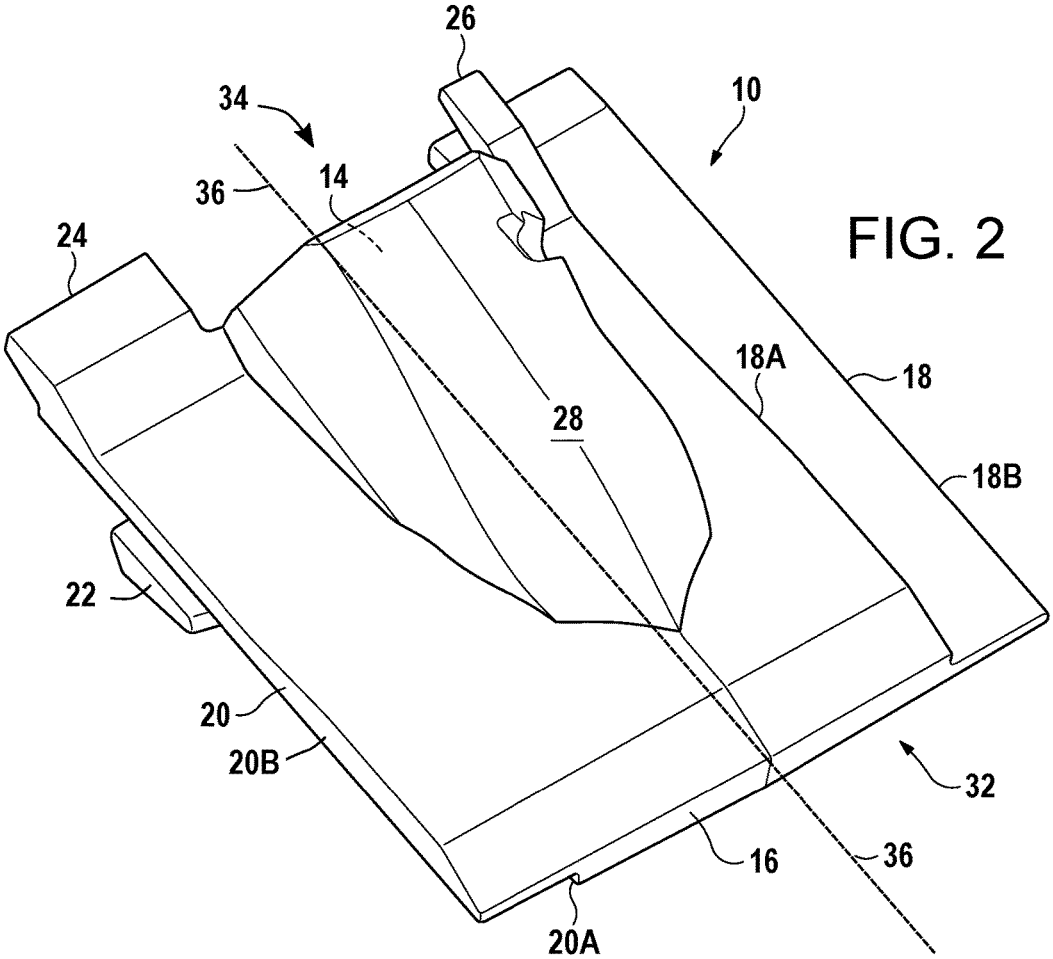
FIG. 2 is an upper perspective view of part of the wear assembly of FIG. 1, namely a wear member.
Figure 3:
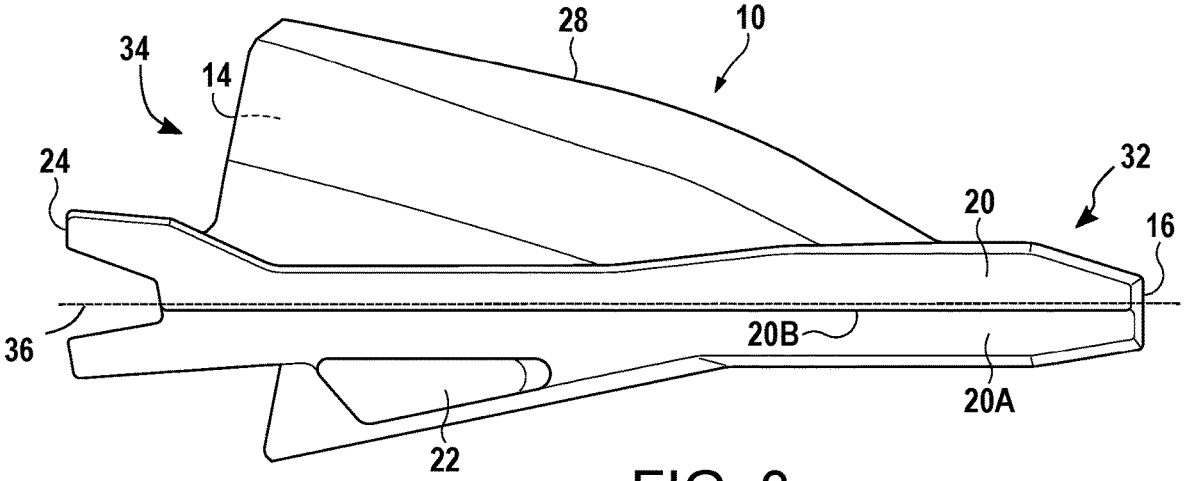
FIG. 3 is a side view of the wear member of FIG. 2.
Figure 4:
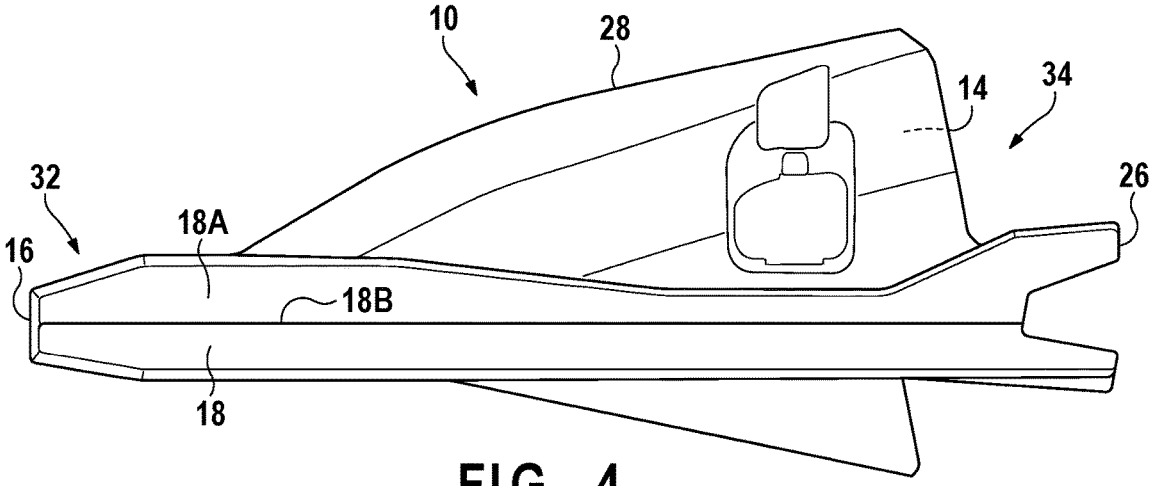
FIG. 4 is a side view of the wear member of FIG. 2, viewed from the opposite side to that shown in FIG. 3.

Tooth 10 of wear assembly 12 includes a working portion 32 (best seen in FIGS. 2 and 3) tapering to a narrowed front working edge 16 and a mounting portion 34 (best seen in FIGS. 2 and 3) that includes a rearward opening cavity 14 that receives a nose 8B extending forward of the lip plate 8. The mounting portion 34 includes a lip mount comprising one or more rearwardly extending legs 24 and 26 on one or each side of cavity 14. In this embodiment each leg 24, 26 straddles (above and below) the lip plate 8 thereby providing stabilization for the tooth 10 and resisting rotational forces on the tooth 10.

Cavity 14 is defined by top, bottom and side walls that form a central body 28 of the tooth 10. The tooth body 28 preferably includes an opening 28A that receives a lock 30 to releasably secure the tooth 10 to the lip 9 (via the adapter 8A). Cavity 14 and opening 28A could have a shape selected from a number of different shapes to suit the kind of fit, stabilization, locking, etc. that is desired for a particular application of the tooth 10. In the illustrated embodiment, the cavity 14, opening 28A and lock 30 received into opening 28A are as disclosed in U.S. Pat. No. 7,882,649, which is incorporated by reference herein in its entirety. Each tooth 10 has a longitudinal axis 36 that is defined by a centerline extending generally in the direction of advancement of the lip 9 during operation of the earth working equipment.

During use, the tooth 10 contacts the earth or other material during the excavation process to protect the lip 9, ease penetration and/or gather material in the bucket. The front edges 16 of the teeth 10 when installed on the lip 9 can collectively align to form a generally continuous linear edge that can be used for leveling or flattening earth or digging smooth walled and/or floored holes or other digging operations. This wider configuration of each tooth 10 to form a generally continuous edge can generate increased risks of the tooth 10 bending or turning (i.e., generally about axis 36) during digging. The above-mentioned legs 24, 26 on both sides of the lip plate 8 help resist such turning. Tooth 10 includes a first lateral portion or wing 18 that extends away laterally from body 28 and a second lateral portion or wing 20 that extends away laterally on the opposite side from body 28. Each lateral portion 18, 20 extends for most of the length of the tooth 10 from the working portion 32 to the mounting portion 34, but in other embodiments they may have gaps or extend only partially along the length. Wings 18, 20 overlap with the wings (20, 18 respectively) on adjacent teeth 10 to ensure a generally continuous edge without significant gaps and/or provide support against turning of the teeth about axis 36. The lateral portions 18, 20 decrease in thickness, e.g., in a step fashion, as they extend laterally from the body 28. Each lateral portion 18, 20 defines an edge 18A and 20A from which a tongue 18B, 20B extends. Opposite surfaces of the tongues 18B, 20B provide complementary formations to each other, so that tongues 18B, 20B from adjacent teeth 10 slidingly engage in an overlapping relationship with corresponding tongues 20B, 18B respectively of the adjacent teeth 10, thereby providing a partial overlap of the lateral portions 18, 20.

Figure 5:
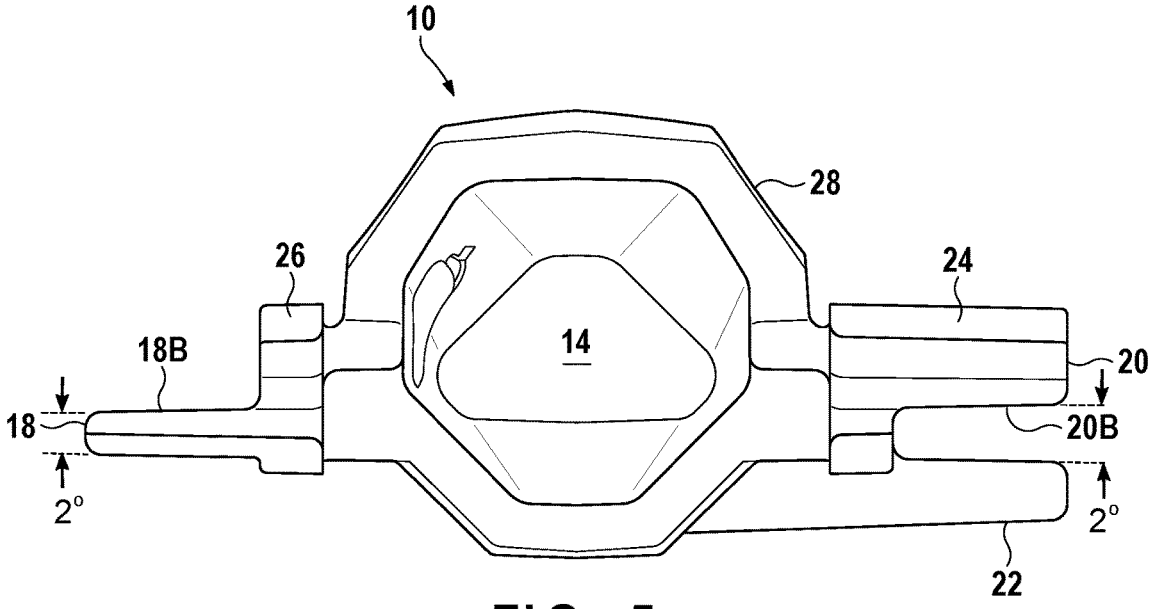
FIG. 5 is a rear view of the wear member of FIG. 2.
Figure 6:
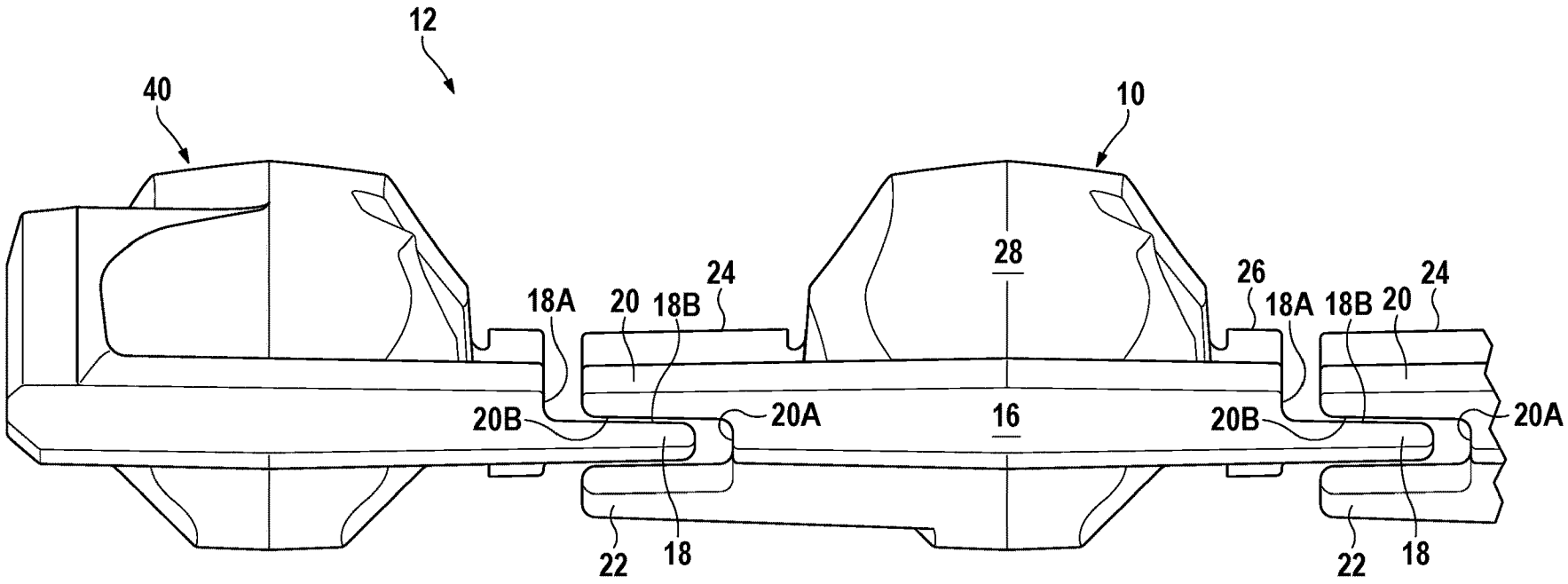
FIG. 6 is a front view of part of the wear assembly of FIG. 1 illustrating a left corner wear member adjacent the wear member of FIGS. 2 to 5.
Figure 7:
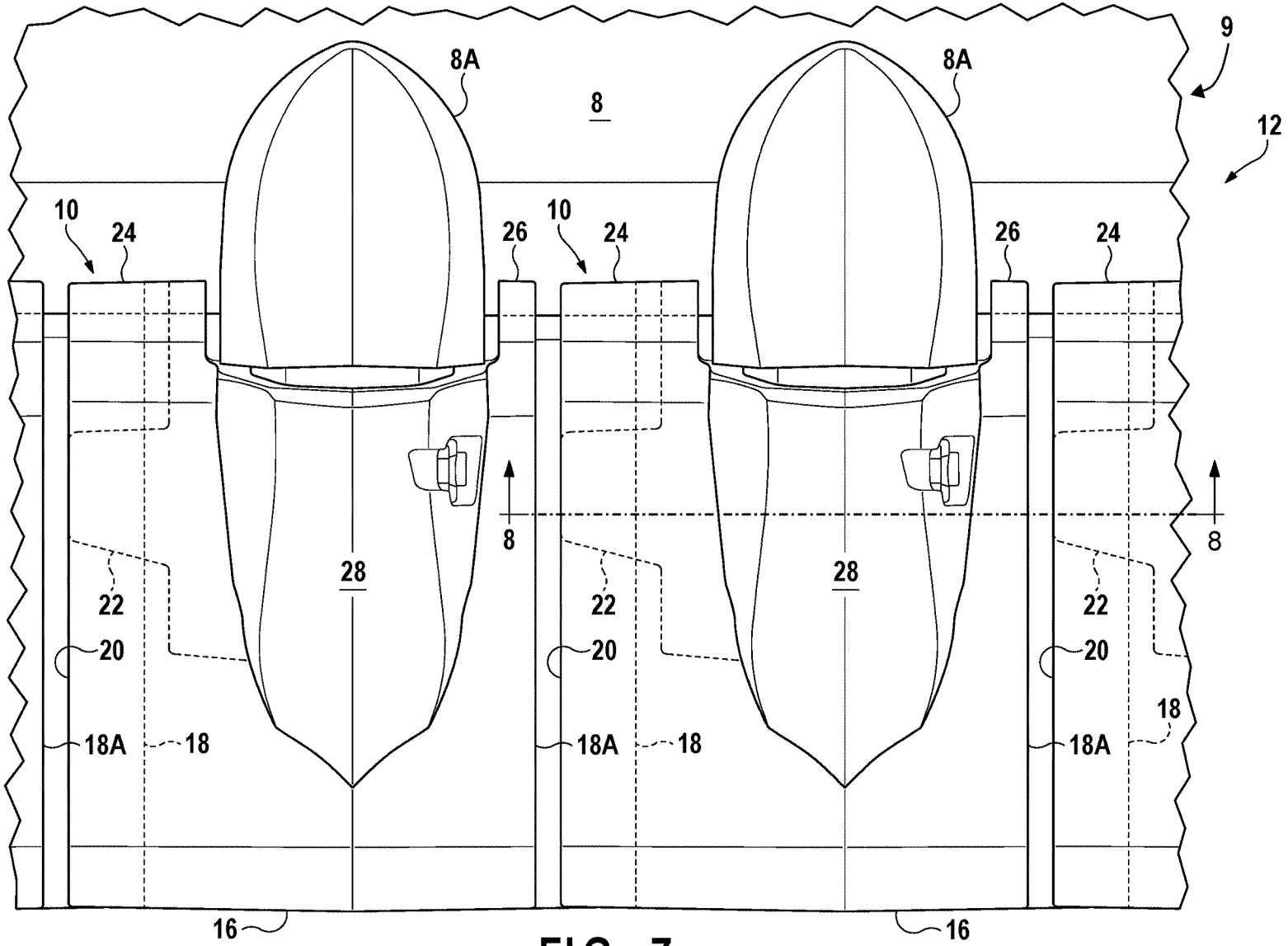
FIG. 7 is a top view of a central part of the wear assembly of FIG. 1.

The lateral portions 18, 20 extend laterally to peripheries or edges that are parallel on opposite sides and perpendicular to the linear leading edge to form a generally rectangular shape but could alternatively have non-parallel and/or non-linear side edges. In this embodiment, the lateral portions 18, 20 comprise generally planar surfaces that have a small slope, as shown in FIG. 5. An upper surface of the first lateral portion 18 has a downward slope (two degrees) away from the body 28; whereas, a lower surface of the second lateral portion 20 has a similar but upward slope (two degrees) away from the body 28.

The lateral portions 18, 20 can be at staggered positions (or vertically offset). One lateral portion 20 can extend on a plane above the longitudinal axis 36 and the opposite lateral portion 18 can extend on a plane below the longitudinal axis 36. The tooth 10 can include an optional, additional (third) laterally extending portion or wing 22 extending laterally from body 28 below and spaced from wing 20. Lower lateral portion 22 can be narrower than the upper lateral portion 20 extending forward and back only a limited distance. This construction is preferred to reduce the removal force when impacted earthen fines are present, and to reduce the distance for complete disengagement, but other arrangements are possible. Wing 22 can provide additional resistance to turning of the tooth about axis 36; i.e., the upper and lower lateral portions 20 and 22 form an opening (an insertion gap) that accepts the lateral portion 18 (an insertion portion) of an adjacent tooth 10 to stabilize the tooth 10 from rotation about the nose 8B. Other or additional overlaps could be provided.

While a linear leading edge for the assembly 12 is illustrated, other configurations can be provided. The leading edges of the assembly 12 can form a continuous linear leading edge angled to the longitudinal axis 36, a curved edge, a staggered edge, or linear edge portions that meet at an angle where the lateral portions overlap with adjacent wear member lateral portions.

In the illustrated embodiment, the first and second lateral portions 18 and 20 each includes a planar face 18B and 20B substantially parallel to a plane through the longitudinal axis 36 that bears on the corresponding planar face of the adjacent tooth 10, but non-parallel surfaces are possible. Some wear members (or corner teeth) 40, 44 are provided as corner members.

In particular, left corner tooth 40 includes only the first lateral portion 18; and the right corner tooth 44 includes only the second lateral portion 20.

Each corner tooth 40, 44 can include both lateral portions, if desired. In general, each corner tooth 40, 44 can have one of the lateral extensions included on teeth 10. In the illustrated embodiment, the corner tooth 40 includes leg 26 and wing 18, and corner tooth 44 includes leg 24 and wings 20, 22. Alternatively, teeth 10 could be used on the ends and form the corner teeth as well as the medial teeth. Also, alternatively, other configurations of corner tooth could be used.

In the illustrated embodiment, tongue 18B is a continuous extension of the bottom surface of the wing 18, while tongue 20B is a continuous extension of the top surface of the wing 20. However, different configurations may be selected, such as tongue 20B being along the bottom and tongue 18B along the top, both tongues 18B, 20B being along the top surface or both along the bottom surface (in which case the adjacent teeth would have the opposite configuration), or having a tongue and groove arrangement (e.g., wing 18 could have a central orientation and wing 20 could be formed by two spaced apart lateral extensions to receive tongue 18B of the adjacent tooth).

Figure 11:
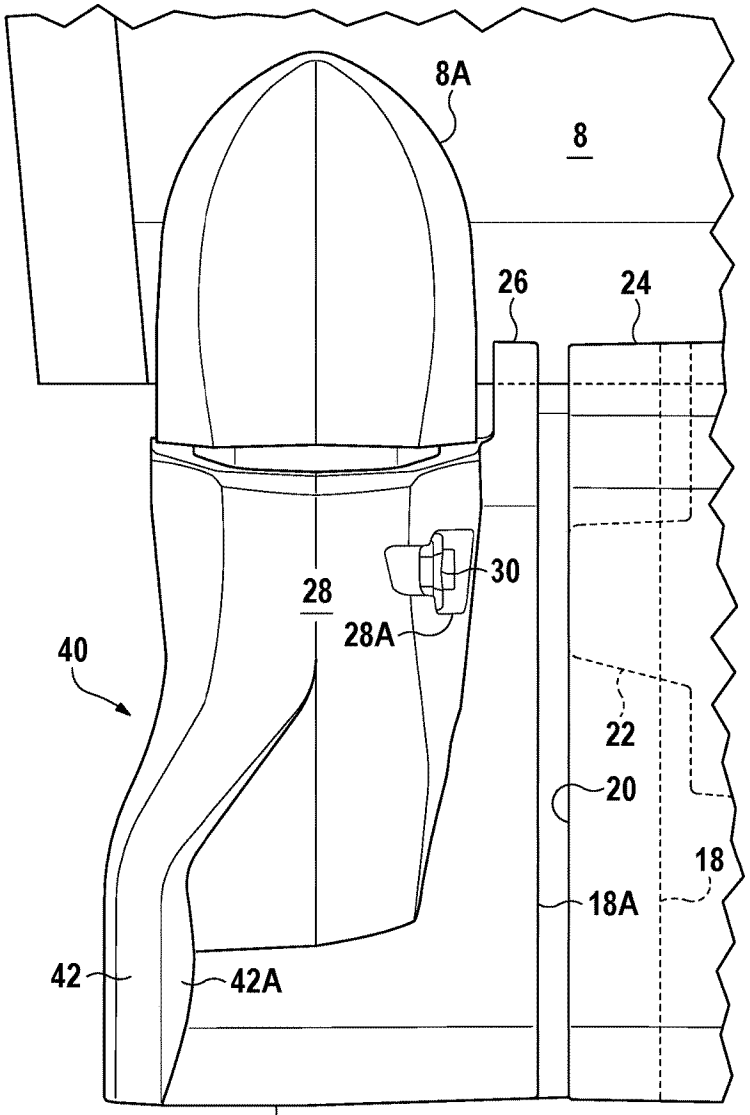
FIG. 11 is a top view of a left corner wear member from the wear assembly of FIG. 1.

In the illustrated embodiment, left corner tooth 40 (see particularly FIGS. 1 and 11) includes a body 28 with rear cavity 14 and lock opening 28A, rearward extending legs 26 to straddle the lip plate 8, working edge 16 and lateral portion 18 similar to lateral portion 18. The corner teeth 40, 44 of the wear assembly 12 typically experience increased wear as compared to the medial teeth 10 and the exposed square corner can become rounded. Left corner member 40 includes a thickened outer edge or upright arm 42 with an inner face 42A to form an edge wall. The edge wall can optionally curve inward and/or be inclined inward extending rearward from working edge 16. The inward curve of face 42A can guide collected material inward toward the center of the bucket. Alternatively, the horizontal thickness of the outer edge can increase, diverging as it extends rearward to guide collected material toward the center of the lip 9 during operation. The increased thickness of the wear member outer edges (or arms) 42 provides additional material at a high wear area of the assembly 12, increases the life of the corner wear member 40 and/or guides earth material into the bucket during use.

Figure 12:
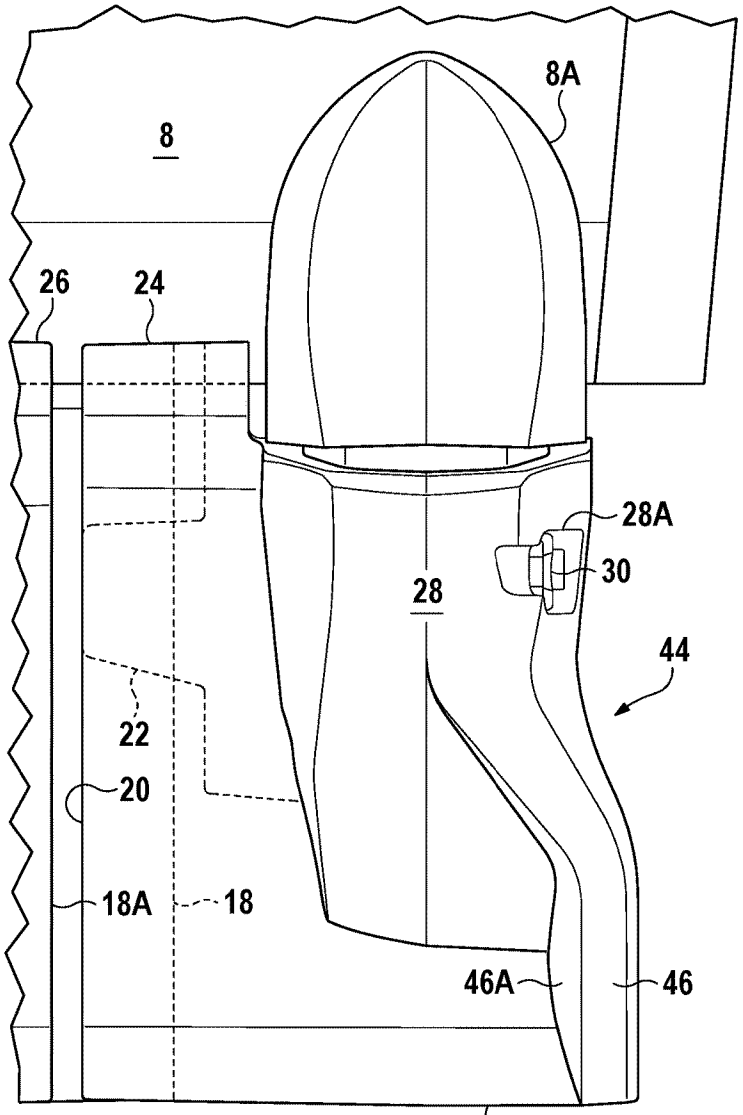
FIG. 12 is a top view of a right corner wear member from the wear assembly of FIG. 1.

Right corner tooth 44 (see particularly FIGS. 1 and 12) includes a rearward opening cavity 14, rearward extending legs 24 to straddle the lip plate 8, a thickened edge or upright guide 46 (preferably a mirror image of edge (or arm) 46 on corner member 40) to resist wear with an inner face 46A. Right corner member 44 can include an upper lateral portion 20 on the edge with a lower lateral portion 22 similar to previously described teeth 10.

The working edge 16 engaging earthen materials generates forces on the supporting surfaces of the teeth 10, 40, 44. The additional width of the teeth 10, 40, 44 provided by the lateral portions 18, 20 generates strong torque forces on the teeth 10, 40, 44 during operation. Assembling the teeth 10, 40, 44 to the digging edge of the bucket, the lateral portions 18, 20 of each tooth 10 overlap with lateral portions 20, 18 respectively, of adjacent teeth 10. Lateral portion 18 can be received in the gap between lateral portion 20 and 22 of the adjacent tooth 10 to provide support to the adjacent lateral portion 20, 22.

The rearwardly extending legs 24 and 26 bear on the lip plate 8. These bearing surfaces at the side of the teeth 10 and the rear of the teeth 10 as well as the bearing surfaces in cavity 14 bearing on the nose 8B stabilize the teeth 10 and resist torque, vertical and/or axial forces generated by digging operations.

The wings 18, 20, 22 and legs 24, 26 as well as possibly other portions of teeth 10, 40, 44 are interlocked with each other and/or the lip plate 8 for support in resisting the various digging forces likely to be encountered during use and/or forming the continuous edge. The teeth also preferably form open removal paths for each of the overlapping portions 18, 20, 22, 24, 26 to move forwardly independently of the adjacent teeth to permit individual replacement of each tooth 10, 40, 44. Conventionally, teeth forming continuous edges have been overlapped for support in ways that require removal of adjacent teeth when replacement of a tooth is needed. Whereas in the illustrated embodiment, wing 18 can slide forward relative to wings 20, 22 with which it overlaps on the adjacent tooth, and wings 20, 22 can slide forward relative to the wing 18 with which it overlaps. The adjacent teeth also do not block the forward movement of legs 24, 26 straddling lip plate 8. In the illustrated embodiment, the removal path for each tooth 10, 40, 44 is along a linear path but in other embodiments, the removal path could have a non-linear path; as one example, the removal path could be curved.

With the tooth seated on the nose 8B of adapter 8A (which is received in cavity 14), lock 30 can be inserted into opening 28A. The lock 30 can be a hammerless lock, if preferred, but that is not required.

These embodiments are described herein in the context of a wear assembly for one kind of bucket. It should be understood that this is merely one example of the disclosed subject matter and is not meant to be limiting. Wear members in accordance with the present invention may have other constructions for use on a wide variety of buckets including, for example, buckets for hydraulic excavators, loaders, cable shovels, face shovels, etc., or for use on other products. Relative terms such as top, bottom, forward, rearward, left and right are used herein for ease of discussion and are not intended to be limiting.

With reference to the drawings, this specification describes particular embodiments and their detailed construction and operation. The embodiments described are set forth by way of illustration only and not limitation. The described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments. It is intended that subject matter disclosed in any one portion herein can be combined with the subject matter of one or more other portions herein as long as such combinations are not mutually exclusive or inoperable. In addition, many variations, enhancements and modifications of the concepts described herein are possible. Those skilled in the art will recognize that many variations can be made to the details of the above-described embodiments without departing from the underlying principles of the invention; for example, in other embodiments, the lateral portions 18, 20 may be mounted lower down or further up on the body 28 than described above or illustrated on the drawings.

The invention claimed is:

1. A wear member for mounting to a lip plate of a bucket, the wear member defining a longitudinal axis along a centerline extending in the direction of advancement of the earth working equipment, the wear member comprising:

a body having:

a rearwardly opening cavity dimensioned to receive a nose extending forward of the lip plate;

first and second lateral portions extending from opposing sides of the body and, the first and second lateral portions defining a front edge for engaging earth and side edges extending between the lip plate and the front edge, the first lateral portion defining a first complementary formation and the second lateral portion defining a second complementary formation, wherein the first and second complementary formations engage opposing complementary formations on adjacent identical wear members to (i) enable axial insertion and removal of the wear member mounted between the adjacent wear members on the bucket and (ii) resist rotational movement of the wear member about the longitudinal axis; and a lip mount including a pair of rearward extending portions disposed on opposing lateral sides of the body aligned with a rear surface of the body and being dimensioned to engage on an upper and lower surface of a lip plate on an excavating bucket to provide further resistance to rotational movement of the wear member about the longitudinal axis.

2. A wear member according to claim 1, wherein each of the pair of rearward extending portions comprises a pair of arms dimensioned and configured to engage with the lip plate.

3. A wear member according to claim 1, wherein the complementary formations on the first and second lateral portions comprise offset planar surfaces.

4. A wear member according to claim 3, wherein the planar surfaces are offset in a direction transverse to a plane extending through one of the first and second lateral portions.

5. A wear member according to claim 4, wherein the planar surfaces have substantially the same lateral width and extend forwards of the body.

6. A wear member according to claim 1, wherein the front edge provides a continuous edge substantially free from gaps.

7. A wear member according to claim 1, further comprising a third lateral portion located beneath the second lateral portion, the second and third lateral portions defining an insertion gap therebetween, and the first lateral portion further comprises an insertion portion defined by the first complementary formation that is received in the gap of one of the adjacent wear members.

8. A wear member according to claim 7, wherein the third lateral portion extends for substantially the same lateral width as the second lateral portion but only extends part-way along the length of the second lateral portion.

9. A wear member according to claim 8, wherein the third lateral portion is located closer to a rear of the wear member than to the front edge.

10. A wear member according to claim 8, wherein the third lateral portion and the complementary formations of the first and second lateral portions include planar surfaces that are generally aligned.

11. A wear member according to claim 1, further comprising a coupling surface defined by the first lateral portion; and an arm upstanding from the second lateral portion in a transverse direction to the longitudinal axis and extending from the front edge towards the body, the arm defining an inner face opposite the body and inclined thereto to guide earth towards the body.

12. A wear member according to claim 11, further comprising a lip mount including a pair of rearward extending portions disposed on opposing lateral sides of the body and being dimensioned to engage on an upper and lower surface of a lip plate on an excavating bucket to provide further resistance to rotational movement of the wear member about the longitudinal axis.

13. A wear member according to claim 12, wherein each of the pair of rearward extending portions comprises a pair of arms dimensioned and configured to engage with the lip plate.

14. A wear member according to claim 11, wherein the first lateral portion is on a left side of the body and the coupling surface is defined on a lower surface of the first lateral portion, and the wear member further comprises a third lateral portion located beneath the first lateral portion, and defining an upper surface, the first and third lateral portions defining an insertion gap therebetween.

15. A wear member according to claim 11, wherein the first lateral portion is on a right side of the body and the coupling surface is defined on an upper surface of the first lateral portion for insertion into an insertion gap by movement along the longitudinal axis.

* * * * *